United States Patent [19]

Meixner

[11] 4,177,375

[45] Dec. 4, 1979

[54] HEATING DEVICE HAVING AN OPTIMIZED HEATING ELEMENT OF PTC THERMISTOR MATERIAL

[75] Inventor: Hans Meixner, Haar, Fed. Rep. of Germany

[73] Assignee: Siemens Aktiengesellschaft, Berlin & Munich, Fed. Rep. of Germany

[21] Appl. No.: 946,634

[22] Filed: Sep. 28, 1978

[30] Foreign Application Priority Data

Sep. 29, 1977 [DE] Fed. Rep. of Germany ..... 2743880

[51] Int. Cl.[2] ..... F27D 11/02

[52] U.S. Cl. ..... 219/441; 219/328; 219/439; 219/462; 219/504; 219/553; 252/520; 338/22 R

[58] Field of Search ..... 219/328, 331, 430, 438, 219/439, 441, 442, 450, 462, 504, 510, 521, 530, 553; 338/22 R, 22 SD; 99/281; 252/520

[56] References Cited

U.S. PATENT DOCUMENTS

| | | | |
|---|---|---|---|
| 3,328,561 | 6/1967 | Sakamoto et al. | 219/442 |
| 3,375,774 | 4/1968 | Fujimura et al. | 219/441 X |
| 3,400,250 | 9/1968 | Buiting et al. | 219/441 |
| 3,441,517 | 4/1969 | Brauer et al. | 252/520 |
| 3,551,644 | 12/1970 | Sano et al. | 219/441 |
| 3,719,796 | 3/1973 | Abildtrup | 219/462 |
| 3,725,643 | 4/1973 | Clausse | 219/441 |
| 3,870,858 | 3/1975 | Schimke | 219/328 |
| 3,876,861 | 4/1975 | Wightman | 219/463 |
| 4,039,771 | 8/1977 | Thorsoe et al. | 219/328 |
| 4,039,772 | 8/1977 | Thorsoe et al. | 219/328 |

FOREIGN PATENT DOCUMENTS 1465439 9/1964 Fed. Rep. of Germany .

OTHER PUBLICATIONS

Electro-Publications, vol. 29, (1976), pp. 589-591, (English translation attached thereto).

Forschung & Entwicklung, vol. 29, (1977), p. 256, (English translation attached thereto).

*Primary Examiner*—Volodymyr Y. Mayewsky

*Attorney, Agent, or Firm*—Hill, Van Santen, Steadman, Chiara & Simpson

[57] ABSTRACT

A heating device is disclosed having a disc-shaped heating element consisting of PTC thermistor material typically operated by a network voltage of 220 volts. The PTC thermistor material has a cut-off control property at a desired cut-off temperature so as to minimize further heat rises of the heating element above the cut-off temperature. In this fashion, the possibility of fire damage is reduced. The heating element has a specific heat output of greater than 50 watts per $cm^2$ and the PTC thermistor material is selected to have a Curie temperature which is at least 50° K. higher than the cut-off temperature. A heating body is provided to affect a substantially even dissipation of heat from two sides of the heating element.

10 Claims, 3 Drawing Figures

HEATING DEVICE HAVING AN OPTIMIZED HEATING ELEMENT OF PTC THERMISTOR MATERIAL

BACKGROUND OF THE INVENTION

The invention relates to a heating device having a disc-shaped heating element consisting of PTC thermistor material having a cut-off control property.

Heating devices have been described in prior art publications for about 2 decades, which have among other things, a disc-shaped heating element consisting of PTC thermistor material. PTC thermistor material relates to ceramic material on the basis of barium titanate having electrical conductivity with a sudden rise of the specific impedance with the so-called Curie temperature. See U.S. Pat. No. 3,441,517. This sudden behavior of the material having a positive temperature coefficient (PTC) was the cause for numerous suggestions to build heating devices with PTC thermistor material, which material - specifically and without the use of additional galvanic control contacts - has a cut-off control property. The cut-off control property is to be understood as a behavior in which the electrical impedance rise of the PTC thermistor material (having the Curie temperature) when heating the PTC thermistor material to temperature values higher than Curie temperature results, in a considerable decrease in the electric current flowing through the material. This can be equated with a reduction of the Joule heat U. I produced in the PTC thermistor material, and is thus equal to a decrease of heat output. The use of PTC thermistor material for heating devices such as, for example, in a solder gun (German Pat. No. 1,690,621) has been repeatedly suggested.

In spite of the numerous and not at all speculative suggestions of the technical world, and although suitable material had also been available for at least more than a decade, and even in spite of continuous demand for heating devices which have an absolutely safe automatic cutoff against overheating, no suggestions have been realized for heating devices having a greater specific heat output than 50 watts per $cm^2$ of the cross-section of a PTC thermistor material disc.

SUMMARY OF THE INVENTION

It is an object of the present invention to disclose a technique with the aid of which heating devices of high output can be realized with PTC thermistor material.

This objective is inventively resolved with a heating device having a disc-shaped heating element with a thickness of from 0.5 to 2 mm and a specific electrical impedance of the heating element at Curie temperature and 2,000 volt/cm being $\rho c = 1 \times 10^3$ Ohm·cm and $6 \times 10^3$ Ohm·cm. The heating element has a specific heat output of greater than 50 watts per $cm^2$ of a cross-section of the disc-shaped element. The cold conductor material is selected to have a Curie temperature which is at least 50° K. higher than the predetermined cut-off temperature. Means are provided for providing a substantially even dissipation and equal transfer of heat from the two sides of the heating element.

In retrospect, with the knowledge of the invention, it seems surprising that this invention has not been disclosed much earlier. However, if one imagines a precise picture of the physical relationships factually underlying the invention, one necessarily reaches the conclusion that a sudden progress in the field of reliable household equipment has been reached. Useful applications of the invention are, in particular, small household appliances such as water cookers, immersible heaters, coffee machines, egg poachers and such. All these devices, if used daily, and if they are heated too long, can become a cause of great fire damage due to a lack of heat decrease after the water has boiled off. Resulting temperatures not only destroy the equipment but can also cause fires.

A number of individual problems are to be mastered with the invention in order to solve the objective posed, these problems being in reciprocal relation with one another. A heating device such as the inventive one is to provide a sufficiently high heating output in the smallest space when connected to a network voltage so that a functional temporary heating operation is facilitated. In contrast thereto is the desire that after boiling-off of remaining liquid, particularly of water, such heating output is no longer produced which could lead to temperatures that would trigger a fire. Thus, the inventive device must make optimum use of the specific control material property of the PTC thermistor material. Also, however, the best possible dimensions of the geometric measurements of the PTC thermistor material disc, on the one hand, and of the electric properties of the material and also an appropriate material selection, on the other hand, are obtained.

The thickness measurements of the disc, disclosed according to one characteristic of the invention, are adjusted to the range of the specific electric impedance of the PTC thermistor material disclosed, measured at Curie temperature, and indeed such that a smaller specific impedance (and vice versa) is preferred to an optimum dimension with greater thickness measurements. Therefore the PTC thermistor material must inventively have a Curie temperature whose value is at least 50° K. higher than the prescribed cut-off temperature. The cut-off temperature is defined as the temperature which must be reached in this heating device and above which substantial cut-off control resulting from substantial impedance rises in the PTC thermistor material occur. Thus, the minimum Curie temperature of the material is at least 150° C. in equipment for heating and evaporating of water--for example in coffee machines and egg poachers, in which the evaporation results intentionally, and in water cookers in which the complete evaporation of the water is the beginning of the danger zone (under the presumption of normal air pressure conditions). For this case, Curie temperatures between 200° and 240° C. are preferred. The upper limit of the Curie temperatures is primarily determined by the respective danger of fire.

The selection of thickness measurements, specific electric impedance, and magnitude of the Curie temperature according to the invention, results in obtaining, as required, a high specific heat output of more than 50 watts per $cm^2$. The disc-shaped cross-section is provided by the surface which is vertical relative to the thickness direction of the disc, i.e. in a circular disc this is the circular cross-section area.

Part of the invention also is the additional requirement that the Joule heat output of the disc is quantitatively equally taken out from both disc surfaces. The equality of heat take-out from both disc surfaces lying opposite to one another is more important than a proper dissipation of heat.

All the inventive techniques result in a high electric heat output from PTC thermistor material discs of minimum volume and indeed with an optimum control ratio of, for example 8:1. Control ratio is to be understood such that the heat output produced previously for the desired heating-up decreases to one eighth when the temperature rises in excess of the cut-off temperature. This has the effect that only a moderate temperature increase and particularly a temperature increase without danger results in excess of the cut-off temperature.

For one skilled in the art interested in a detailed theoretical basis for the invention, it is desirable to explain the curve diagram disclosed in FIG. 1 which was plotted for PTC thermistor material having a Curie temperature of 220° C. situated in water, and having a cut-off temperature of 100° C. "a" represents the typical current-voltage characteristic of a PTC thermistor material. The voltage value at 220 volts is particularly emphasized. "b" represents the dependency of the electrical impedance of a PTC thermistor material disc having a specific impedance as stated. This curve b already contains the measurements with a thickness in the inventively disclosed range. "c" represents the output-voltage characteristic based upon the inventively dimensioned PTC thermistor material disc. Optimum conditions are then present when, as illustrated in FIG. 1, the maximum of the current lies at a voltage value which is approximately 70% of the prescribed operating voltage, for example, of the network voltage of 220 volts.

DESCRIPTION OF THE PREFERRED EMBODIMENTS

Figure 1:
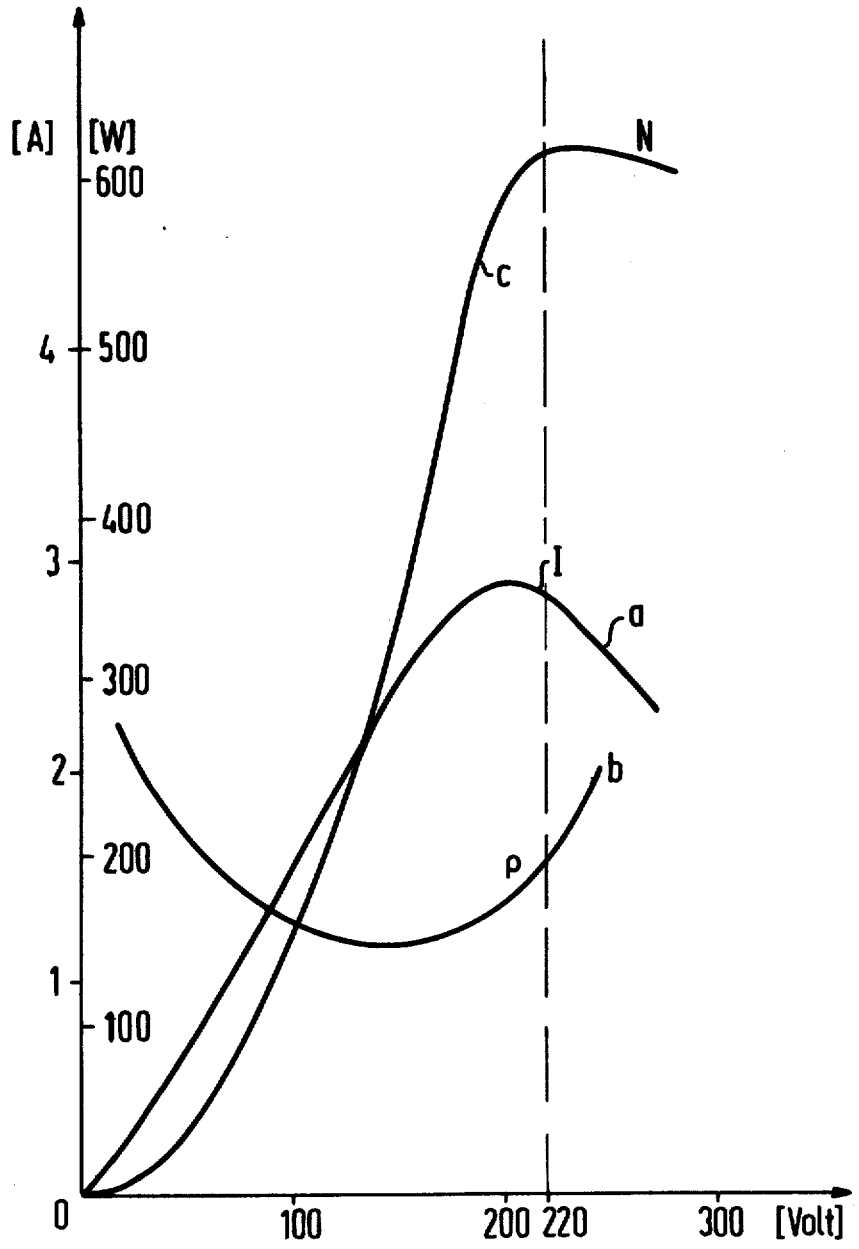
FIG. 1 is a curve diagram explaining operation of the PTC thermistor material utilized in the heating device of the invention.
Figure 2:
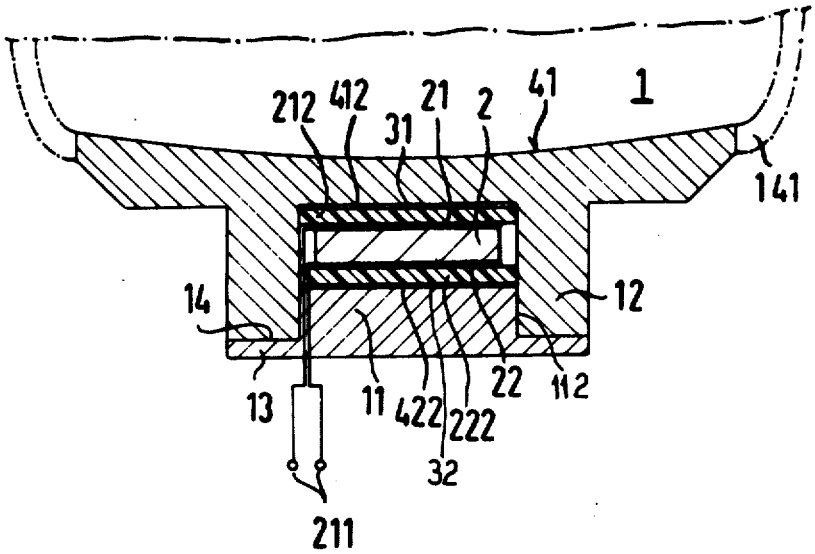
FIG. 2 illustrates an inventive utilization in an egg poacher or cooker.

A body consisting of a properly heat-conducting material such as, for example, metal, is referenced 1 in FIG. 2. This body 1 has a surface 41 to which the electric heat to be produced is to be given off to a medium such as, for example, liquid. The receptacle necessary, for example, for accommodating a liquid is for the sake of overview only indicated as reference numeral 141 in the Figure. This, for example, can be the receptacle of an egg cooker.

2 references a disc consisting of PTC thermistor material, for example, having the measurements 32 mm diameter and 1.5 mm thickness, for the output of 500 watts. This disc 2 is located in a recess obvious from the sectional illustration of FIG. 2, and such that the one surface 21 of disc 2 lies opposite a surface 31 of body 1 as plane parallel as possible.

In order to inventively safeguard a heat removal on both sides, a component 11 of body 1 is provided which fits with the other component 12 of body 1, as is obvious from FIG. 2. A surface 32 of this component 11 lies opposite the second surface 22 of disc 2. A proper heat contact is present between components 11 and 12, for example, via a cylindrical screw thread or via a cylindrical press fit at surface 112. Additionally, a heat contact can also be provided between a cover-like part 13 of component 11 having a surface 14 and the other component 12 of the body of appropriate size.

The disc 2 consisting of PTC thermistor material has thin electrode coatings or layers consisting of a material normally used for PTC thermistors on the two surfaces 21 and 22. These electrode coatings or layers are illustrated only in outline, for the sake of overview. The electric connection lines 211 of these electrodes are merely schematically indicated.

Since normally both components 11 and 12 of the body 1 are produced of electrically conductive material such as, for example, metal, and electrical insulation is necessary to prevent a short circuit between the electrodes situated on the surfaces 21 and 22. Such an electrical insulation which also has a proper heat conductivity, can be produced by means of an intermediate layer 212, 222 consisting, for example, of Be-oxide, Al-oxide, Mg-oxide or consisting of silicone resin. Such a layer is situated between the surfaces 21 and 31, and 22 and 32.

In the heating device of the invention and indeed particularly for high output operation, a very homogenous dissipation of heat from disc 2 to only one of the heating surfaces 41 of body 1 giving off heat is present. The two partial heat currents, proceeding from the two surfaces 21 and 22 of disk 2 are combined into heating surface 41 for a common heat current in the inventively designed body 1. The two partial currents are inventively essentially dimensioned of even value with regard to dissipation of heat. This homogeneity facilitates obtaining an output control ratio of, for example, 8:1. This ratio describes the decrease in the production of electrical heat when the self-control temperature of the inventive heating device is reached.

Advantageously only very thin, for example, less than 2 mm thick discs 2 are utilized, which are sufficiently thick so that no electric breakdowns occur through the disc.

The electric current and the heating current flows through disc 2 in parallel. It is recommended to provide a heat conductivity of at least 0.2 watt per cm (°K.) for the heat-conducting electrically insulating material between the surfaces 21 and 31 or 22 and 32, respectively.

It is advantageous to provide a layer 412 or 422, respectively, consisting of a material with ductile properties, between the surfaces 31 and/or 32, on the one hand, and between the insulating layer 212 and/or 222, on the other hand. This material provides a certain layout pressure and pressure adjustment between the PTC thermistor material disc and opposite surfaces of body 1. Pb, Pb-In, In,Cd-In, Cd-In-Pb, are suitable, therefore, as materials. The current feed-line to the electrodes can also proceed via such ductile material if it is arranged between the disc 2 and the respective layer 31 or 32 consisting of electrically insulating material.

An inventive heating device having a thickness measurement range of 0.5 to 2 mm for the disc 2 can be operated with 220 volts. Accordingly an adjusted specific impedance of the PTC thermistor material with a Curie temperature and 2000 volts/cm amounts to $1\times10^3$ through $6\times10^3$ Ohm-cm. The material-specific (Curie-) temperature of the material is therefore at least 50° K. higher than the prescribed operating-heating temperature which is, for example, 100° C. in egg cookers.

On the basis of the self stabilization effect of the PTC thermistor material, the heating device of the invention is very fire safe because impermissible overheating by itself is impossible.

Figure 3:
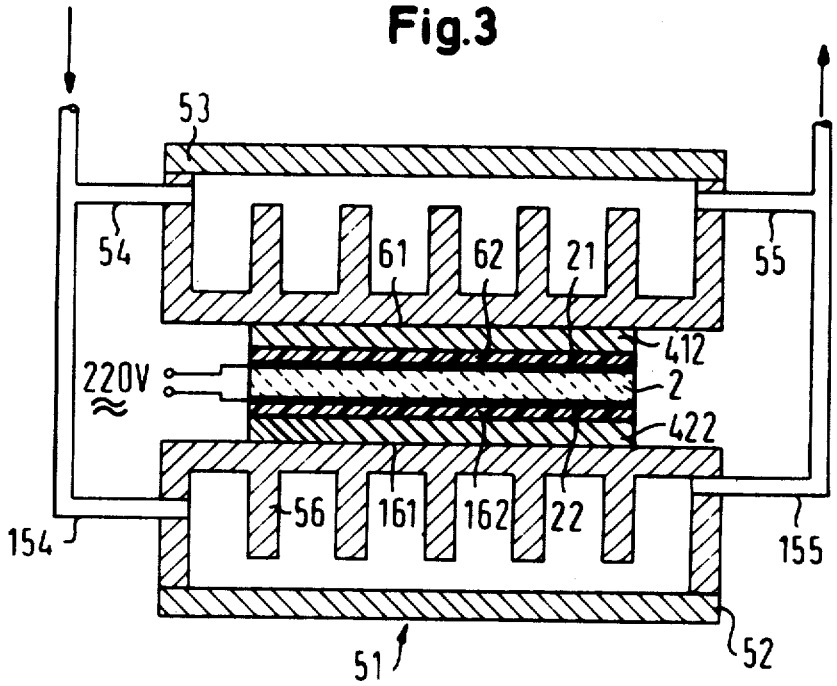
FIG. 3 illustrates an inventive utilization in a continuous flow heater, for example, for a coffee machine.

FIG. 3 shows a continuous flow heater heated with a PTC thermistor material suitable, for example, for a coffee machine.

The total heating device is referenced 51 in FIG. 3. This heating device consists of two components 52 and 53 which are designed as receptacles for the continuous flow heater connected in parallel, and which have even flow-through in comparison to one another. The liquid to be heated is advantageously water. In flow tube lines are referenced 54 and 154 and out-flow tube lines are referenced 55 and 155. Ribs are used for an improved heat delivery are referenced 56. These ribs 56 project into the respective receptacles 52 and 53. The surfaces 61 and 161 of receptacles 55 and 155 are the actual heat absorbing surfaces which are to be heated.

The division according to the invention of a continuous flow heater receptacle utilized in accordance with the known art into two individual receptacles is used to accommodate the heating element, which inventively is a disc 2 consisting of PTC thermistor material situated between the two already mentioned surfaces 61 and 161. By means of the identical design of receptacles 52 and 53 according to the invention, including the inflow and outflow lines, it is guaranteed that the PTC thermistor material disc 2 is capable of respectively giving off the same amount of heat to these receptacles. The two surfaces 21 and 22 of disc 2 giving off heat can thus be held at the same temperature. Due to the small thickness range of 0.5 to 2 mm for the disc, it can also be guaranteed that zones of disc 2 lying further to the interior (with a given heat conductivity of the ground conductor material) are always approximately at the same temperature as the surfaces 21 and 22. It is important to point out that even heat delivery is more important than an extremely efficient heat delivery for only one of the surfaces 21, 22.

The disc 2 consisting of PTC thermistor material has thin electrode coatings consisting of a material normally used for PTC thermistor material such as chromium or aluminum, said coatings being situated on the two surfaces 21 and 22. These electrode coatings or layers are, for the sake of overview, only illustrated as a heavy line. The electric connection lines 211 of these electrodes are merely indicated schematically.

Normally the two receptacles 52 and 53 consist of metal and are accordingly electrically conductive. Therefore a layer, consisting of electrically insulating material, is respectively provided between the surface 21 or 22, on the one hand, and the surfaces 61 or 161 of receptacles 52, 53, on the other hand. Materials such as Be-Oxide, Al-Oxide, Mg-Oxide or even silicon resin are suitable therefore. These electrically insulating materials are properly heat-conducting. The layers, formed therefrom, are referenced 62 and 162.

The total heating device, illustrated in FIG. 3 (together with receptacles 52, 53) are advantageously held together with a device (not illustrated for the sake of overview) in order to exert pressure. It is thereby recommended, with regard to the pressure forces, in view of the defined compression strength of the PTC thermistor material disc 2, that between the surfaces 31 and/or 32 on one hand and of the insulation 212 and/or 222 on the other hand, a layer 412 or 422 is provided consisting of a material having ductile properties. Therefore a given layout pressure and pressure adjustment can be obtained between the PTC thermistor material disc 2 and the surfaces 61 and 161 lying opposite thereto. Materials having sufficient ductile properties are suitable such as lead, lead-indium, indium, cadmium-indium, and cadmium-indium-lead.

With the aid of the invention as illustrated, a heat production having a magnitude of from 500 to 1000 watts can be obtained without difficulties and indeed with dimensions as already stated above.

In coffee machines it is normal to keep the finished beverage warm so that the heating element is intermittently operated and regulated by a thermal switch. However, this regulation does not take into consideration how much liquid is to be kept warm yet. However, in the invention the heating element keeps the coffee beverage at a practically constant temperature, independently of the amount remaining.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A heating device, comprising:

(a) a disc-shaped heating element having first and second major heat surfaces with electrodes thereon, the element being comprised of positive temperature coefficient (PTC) thermistor material;

(b) network voltage means electrically connected to said electrodes for operating the heating element;

(c) said PTC thermistor material having a cut-off control property at a desired cut-off temperature;

(d) the heating element having a thickness from 0.5 to 2 mm when the network voltage is 220 volts;

(e) a specific electrical impedance of the heating element, at Curie temperature and 2000 volt/cm being between $\rho c = 1 \times 10^3$ Ohm·cm and $6 \times 10^3$ Ohm·cm;

(f) the heating element having a specific heat output of greater than 50 watts per $cm^2$ of a cross-section of the disc-shaped element;

(g) the PTC thermistor material being selected to have a Curie temperature which is at least 50° K. higher than the cut-off temperature; and (h) means for providing a substantially even dissipation of heat from the first and second major surfaces of the heating element.

2. The heating device of claim 1 including heating means receiving heat from the heating element for heating a liquid, and the cut-off temperature being provided by a boiling point of the liquid.

3. The heating device of claim 2 wherein the heating means heats and evaporates water.

4. The heating device of claim 1 including heating means receiving heat from the heating element for heating a mixture of liquids, and the cut-off temperature being provided by a boiling point of a component of the mixture which boils at the highest temperature.

5. A heating device according to claim 1 wherein said disc-shaped heating element is in heat contact with a heat-conductive body forming a heat output surface; the heat-conductive body having an interior region in which the heating element is located; said heating element first and second major heat surfaces being respectively in contact with first and second absorbing surfaces of the interior region, said first and second absorbing surfaces having essentially the same effective heat contact with the heat output surface of the heat conductive body.

6. A heating device according to claim 5 in which the body interior region is a cup-shaped recess in a portion of the body, that an additional portion fits in the recess, said additional portion having said second absorbing surface in close heat contact with the second major heat surface of the heating element.

7. A heating device according to claim 6 in which heat contact between the additional portion and the portion of the body containing the recess is a screw thread.

8. A heating device according to claim 6 in which heat contact between the additional portion and the portion of the body containing the recess is a press fit.

9. A heating device according to claim 1 in which the heating element is in heating contact with first and second heat-conductive body means for continuous heat flow, each body means having a heating surface with the heating element being arranged between the heating surfaces of the first and second body means, heat dissipation at the two heating surfaces being substantially the same.

10. A heating device, comprising:

(a) a heating element with electrodes connected thereto having first and second major heat surfaces, the element being comprised of a positive temperature coefficient (PTC) thermistor material formed of ceramic on the basis of barium titinate, the PTC thermistor material having a sharp rise of specific impedance near the Curie temperature of the material;

(b) network voltage means electrically connected to said electrodes for operating the heating element;

(c) said PTC thermistor material having a cut-off control property at a desired cut-off temperature at which heating protection is desired;

(d) the heating element having a thickness from 0.5 to 2 mm;

(e) a specific electrical impedance of the heating element, at the Curie temperature being between $\rho c = 1 \times 10^3$ Ohm·cm and $6 \times 10^3$ Ohm·cm;

(f) the heating element having a specific heat output of greater than 50 watts per $cm^2$ of a cross-section of the disc-shaped element;

(g) the PTC thermistor material being selected to have a Curie temperature which is at least 50° K. higher than the cut-off temperature; and (h) means for providing a substantially even dissipation of heat from the first and second major surfaces of the heating element.

* * * * *